US010207784B2

(12) United States Patent
Mitchell

(10) Patent No.: US 10,207,784 B2
(45) Date of Patent: Feb. 19, 2019

(54) CENTER PIVOT ADJUSTABLE OARLOCK

(71) Applicant: TRUEARC LLC, McLean, VA (US)

(72) Inventor: J. D. Mitchell, McLean, VA (US)

(73) Assignee: TRUEARC LLC VA (US)

( * ) Notice: Subject to any disclaimer, the term of this patent is extended or adjusted under 35 U.S.C. 154(b) by 0 days.

(21) Appl. No.: 15/334,645

(22) Filed: Oct. 26, 2016

(65) Prior Publication Data

US 2018/0346084 A1 Dec. 6, 2018

(51) Int. Cl.
*B63H 16/06* (2006.01)
*B63H 16/067* (2006.01)
*B63H 16/073* (2006.01)

(52) U.S. Cl.
CPC ..... *B63H 16/067* (2013.01); *B63H 16/073* (2013.01); *B63H 2016/063* (2013.01)

(58) Field of Classification Search
CPC ..... B63H 16/00; B63H 16/04; B63H 16/06; B63H 16/073
USPC ..... 440/102, 105, 106, 107
See application file for complete search history.

(56) References Cited

U.S. PATENT DOCUMENTS

| | | | | |
|---|---|---|---|---|
| 2,550,625 | A * | 4/1951 | Vick | B63H 16/06 440/107 |
| 3,677,216 | A | 7/1972 | Gentemann | |
| 4,352,667 | A | 10/1982 | Neville | |
| 6,183,325 | B1 | 2/2001 | Purser | |
| 7,670,201 | B2 | 3/2010 | Winter | |
| 8,002,598 | B2 | 8/2011 | Ninham | |
| 9,022,824 | B2 * | 5/2015 | Jacobson | B63H 16/06 440/106 |
| 9,376,190 | B1 * | 6/2016 | Horan | B63H 16/06 |

* cited by examiner

*Primary Examiner* — Lars A Olson
(74) *Attorney, Agent, or Firm* — Todd L. Juneau; Juneau & Mitchell

(57) ABSTRACT

The invention relates to a center-axis oarlock and methods of providing constant gearing throughout the arc of an oar in a boat or shell.

14 Claims, 8 Drawing Sheets

CENTER PIVOT ADJUSTABLE OARLOCK

CROSS REFERENCE TO RELATED APPLICATIONS

None

STATEMENT REGARDING FEDERALLY SPONSORED RESEARCH OR DEVELOPMENT

None

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention relate to a competitive rowing oarlock and pin system, more particularly, but not exclusively, an oarlock that accommodates modern oars and collars, that pivots on a center axis and that can be attitude adjusted (pitch), limited as to the catch angle and height adjusted without tools or the disassembly of the rigger system.

Background

Rowing is the propulsion of a displacement boat by the muscular force of one or more rowers, using oars as simple levers of the second order and sitting with their backs to the direction of movement of the boat. The object of competitive rowing is to row faster then the other boats in a race. Competitive rowing was an original component of the modern Olympic games. Competitive rowing shells, both sweep (one oar per person) and sculling boats (two oars per person), are moved through the water by oars attached to the boat by Riggers. The Rigger system is comprised of four components: 1) the Oar; 2) the Oarlock; 3) the Oarlock Pin and 4) the Rigger. The power of the rower is transmitted through the force exerted on the oar to the boat through a connection with the boat at the oarlock and the shoes attached to the boat which firmly attached the rower feet to the boat. The oar is a second order fulcrum with the fulcrum point located near the end of the shaft of the oar and the start of the blade of the oar.

The contemporary oar used in racing shells, are an evolution of designs from the early 1900's. Oar Sleeve, a protective structure attached to the oar that acts as a wear plate were described in U.S. Pat. Nos. 2,076,886; 1,003,0069; 1,401,864; and 1,450,475. Contemporary oars feature sleeves ("Collar") made of nylon and/or plastic and are generally asymmetrical molded sleeves affixed to the oar to assist the rower when he or she is squaring the blade and feathering the oar. The Collar, also feature a disk shaped button which forms a concentric ring shape around the molded sleeve, ("the Button"). The Button provides a pivot point that prevents the oar from sliding through the oarlock while the rower is rowing. The Button may be moved longitudinal along the axis of the oar to change the ratio of the inboard and outboard lengths. Sleeves have been invented that allow variable movement of the Button. See U.S. Pat. No. 5,324,218.

The contemporary oarlock used in racing shells, are derived from designs first promulgated in the late 1800. See, generally, U.S. Pat. Nos. 199,011; 282,854; 683,540; 317,430; and 1,097,330. These patents show a basic U-shaped oarlock with a top clasp of varying design, as the precursor to the modern oarlock, though modern materials are generally nylon or plastic, as opposed to brass or metal. Prior to the adoption of the U-shaped oarlock, oarlock were generally simply design that cradled the oar. See, generally, U.S. Pat. No. 611,438. Attempts have been made to improve oarlocks performance through a variety of gimbal type structures. See, generally, U.S. Pat. Nos. 2,559,929; 207,465; and 1,594,063. A tubular section forms one of the sides of the U-shaped section. The tubular section includes a hole for the insertion of an oarlock pin. The oarlock rotates around the oarlock pin.

Gearing

In contemporary oarlock/pin combination the oarlock rotates around the pin with the oarlock pivot on one of it side supports. At the finish of the stroke, the oarlock is pulled towards the rower and the gearing is light. At the catch the oarlock is pushed away from the rower, the effective spread is increased and the oar gearing is heavier.

Injuries

Additionally, as the rower moves to the catch, he or she is required to twist their body outside of the plane of the center of the boat as the oarlock moves away from the center of the pin. This action is a leading cause of injuries in rowers, with ruptures to the L5 vertebra a leading cause of injury to rowers.

Catch Angle

The motion further limits the catch angle (the angle of the oar at the catch in relationship to a line of the perpendicular of the center line of the boat) of the rower. Reduced catch angle is related to reduced boat speed. The prior art does not provide a mechanism that allows for the catch angle to be controlled and limited. Maximum boat speed is achieved when all rowers is a shell achieve the same catch angle. A minor difference of one degree can adversely impact boat speed.

Height

The height of the oarlock in relationship to the height of the rower's seat and shoes are also a concern. The height of the oarlock allows for the hand on the inboard section of the oar to move through a proper plane while the oar moves through the water at the proper depth during the drive, and providing sufficient room to recover the oar during the non-propulsive phase. Prior art included the use of threaded oarlock pin to adjust the oarlock height. See U.S. Pat. No. 6,183,325 B 1. Currently, the height of oarlocks is adjusted by the movement of small spacers or washers. To lower the oarlock a spacer is removed from the bottom of the oarlock/oarlock pin assembly and moved to the top of the assembly. Spacers (pin-located height spacers) used for this purpose normally include washers that are made of plastic. The inherent disadvantage to the use of height spacers is that the oarlock assembly must be disassembled to change the height. Removable spacers are also used on the oarlock pin for easier height adjustment. The spacer is a split clamp made of plastic that can pushed onto or pulled of off the oarlock, without the disassembly of the assembly. See, generally US Patents US20160039508A1 (Pending) and US20120276508 A1.

Pitch

The pitch of the oarlock is the relationship to the surface of the water and the angle of the blade of the oar as it enters the water and during the drive, is also a concern. In particular, current oarlock designs commonly include a fixed pitch which cannot be easily adjusted. Current methods for the adjustment is most commonly the insertion of asymmetrical bushings inserted into the tubular section formed at one of the sides of the U-shaped section. The tubular section includes a hole for the insertion of an oarlock pin with sufficient space to allow for the insertion of the pitch bushing. Alternative devices to adjust Pitch have been developed. See US Patent EP 0016270A1 (79300464.9).

There remains, a very real and substantial need for an effective means for improving the gearing and transmission of power through the oarlock pin, reducing injuries to rowers, improving the catch angle of the oar, improving the oar height adjustment mechanisms, and the improving the process of adjusting of the pitch without the disassembly of the oarlock assembly.

SUMMARY

In one embodiment the oarlock and the oarlock pin are integrated into one unit that, unlike the prior art, is not fixed to the rigger and is held in place by a supporting arm. The supporting arm has openings at either end that allow the combined oarlock and pin to move up and down to allow for adjustment of height but is firmly fixed between the two supporting arms and the rigger. The supporting arms may be constructed of any material, suitable to support and withstand the pressures exerted by the oar against the combined oarlock and pin, including but not limited to molded carbon fiber, stainless steel or aluminum. A bushing is inserted into the openings of the supporting arm and rotation is limited within the rigger by a cam. Thus the bushing and the supporting arm may not move in relationship to the rigger. The combined oarlock and pin is able to move both longitudinally and laterally with the opening of the bushing. The pin is made of any material, such as stainless steel, aluminum or carbon fiber, that is sufficiently strong enough to bear the forces exerted on it by the oar. The oar is introduced into the body of the oarlock by the opening of one side of the oarlock, held in place by a knurled knob that may be tightened to produce a uniform oarlock body. The pin supports a plastic insert that creates the surface the oar rest upon and move on. The plastic insert may be adjust to adjust the pitch. Pitch may be adjusted by placing predefined wedges (pitch blocks) on the oarlock bearing surfaces. The pitch blocks may be removed due to wear or as needed to adjust the pitch of the combined oarlock and pin.

In a preferred embodiment, there is provided a center pivot adjustable oarlock, comprising: (i) an oar housing, the oar housing comprised of a plurality of elongated support members defining an enclosed aperture and configured to receive an oar, and a hinged access gate connected to the plurality of elongated support members for opening and closing the aperture; (ii) a top mounting pin, the top mounting pin comprising an elongated vertically-oriented cylinder connected at a first end to an upper center portion of the oar housing and extending away from the aperture, an upper bushing connected to the top mounting pin, the upper bushing configured to connect to an upper rigger connection; and, (iii) a bottom mounting pin, the bottom mounting pin comprising an elongated vertically-oriented cylinder in the same axis as the top mounting pin and connected to a lower center portion of the oar housing and extending away from the aperture in a direction opposite to the top mounting pin, a lower bushing connected to the bottom mounting pin, the lower bushing configured to connect to a lower rigger connection.

In another preferred embodiment, there is provided a center pivot adjustable oarlock further comprising a C-shaped support arm for mounting the oar housing to the upper rigger connection and the lower rigger connection, where the C-shaped support arm is connected at an upper terminus to the upper bushing, and is connected at a lower terminus to the lower bushing, wherein the upper terminus is positioned between the upper rigger connection and the upper center portion of the oar housing, wherein the lower terminus is positioned between the lower rigger connection and the lower center portion of the oar housing, and wherein the C-shaped support arm creates a indirect connection through the upper bushing between the oar housing and the upper rigger connection, and wherein the C-shaped support arm creates a indirect connection through the lower bushing between the oar housing and the lower rigger connection.

In another preferred embodiment, there is provided a center pivot adjustable oarlock, comprising: (i) an oar housing, the oar housing comprised of a plurality of elongated support members defining an enclosed aperture and configured to receive an oar, and a hinged access gate connected to the plurality of elongated support members for opening and closing the aperture; (ii) a top mounting pin, the top mounting pin comprising an elongated vertically-oriented cylinder connected at a first end to an upper center portion of the oar housing and extending away from the aperture, an upper bushing connected to the top mounting pin; (iii) a bottom mounting pin, the bottom mounting pin comprising an elongated vertically-oriented cylinder in the same axis as the top mounting pin and connected to a lower center portion of the oar housing and extending away from the aperture in a direction opposite to the top mounting pin, a lower bushing connected to the bottom mounting pin; and, (iv) a C-shaped support arm for mounting the oar housing to a rigger, where the C-shaped support arm is connected at an upper terminus to the upper bushing, and is connected at a lower terminus to the lower bushing, wherein the lower bushing is connected to a rigger, and wherein the C-shaped support arm creates a indirect connection through the lower bushing between the oar housing and the rigger.

In another preferred embodiment, there is provided a center pivot adjustable oarlock wherein the top mounting pin and the bottom mounting pin are threaded, and wherein the oar housing is vertically adjustable along the axis of the top and bottom mounting pins.

In another preferred embodiment, there is provided a center pivot adjustable oarlock wherein the hinged access gate is a hinged elongated arm that is connected to the plurality of elongated support members by a hinge at a lower end of the elongated arm, and is connected to the plurality of elongated support members by a quick-release locking knob at an upper end of the elongated arm.

In another preferred embodiment, there is provided a center pivot adjustable oarlock further comprising a pitch angle insert that is replaceably attached to an inner surface of the oar housing.

In another preferred embodiment, there is provided a center pivot adjustable oarlock wherein the pitch angle insert is wedge-shaped and has a first surface to position the oar at a recovery position during a recovery phase of a stroke, and has a second surface to position the oar at a catch position during a catch phase of the stroke, wherein the pitch angle insert is configured to work cooperatively with a collar button attachment that fits on a sleeve portion of the oar mounted in the oarlock.

In another preferred embodiment, there is provided a center pivot adjustable oarlock wherein the upper bushing has one or more screws for adjustably securing the upper bushing to the upper rigger connection, and wherein the lower bushing has one or more screws for adjustably securing the lower bushing to the lower rigger connection.

In another preferred embodiment, there is provided a center pivot adjustable oarlock wherein the plurality of elongated support members and the hinged access gate connected to the plurality of elongated support members are configured in a geometric shape having 4-12 sides.

In another preferred embodiment, there is provided a center pivot adjustable oarlock wherein the plurality of elongated support members and the hinged access gate connected to the plurality of elongated support members are configured in a hexagonal shape, are configured in a toroidal shape, are configured in a square shape, or are configured in a rectangular shape.

In another preferred embodiment, there is provided a method of providing constant gearing throughout the arc of an oar in a boat, comprising the steps of: (i) providing an oarlock that rotates about a central vertical axis; and (ii) horizontally rotating an oar in the oarlock about the central axis of the oarlock.

DETAILED DESCRIPTION OF THE INVENTION

Figure 1:
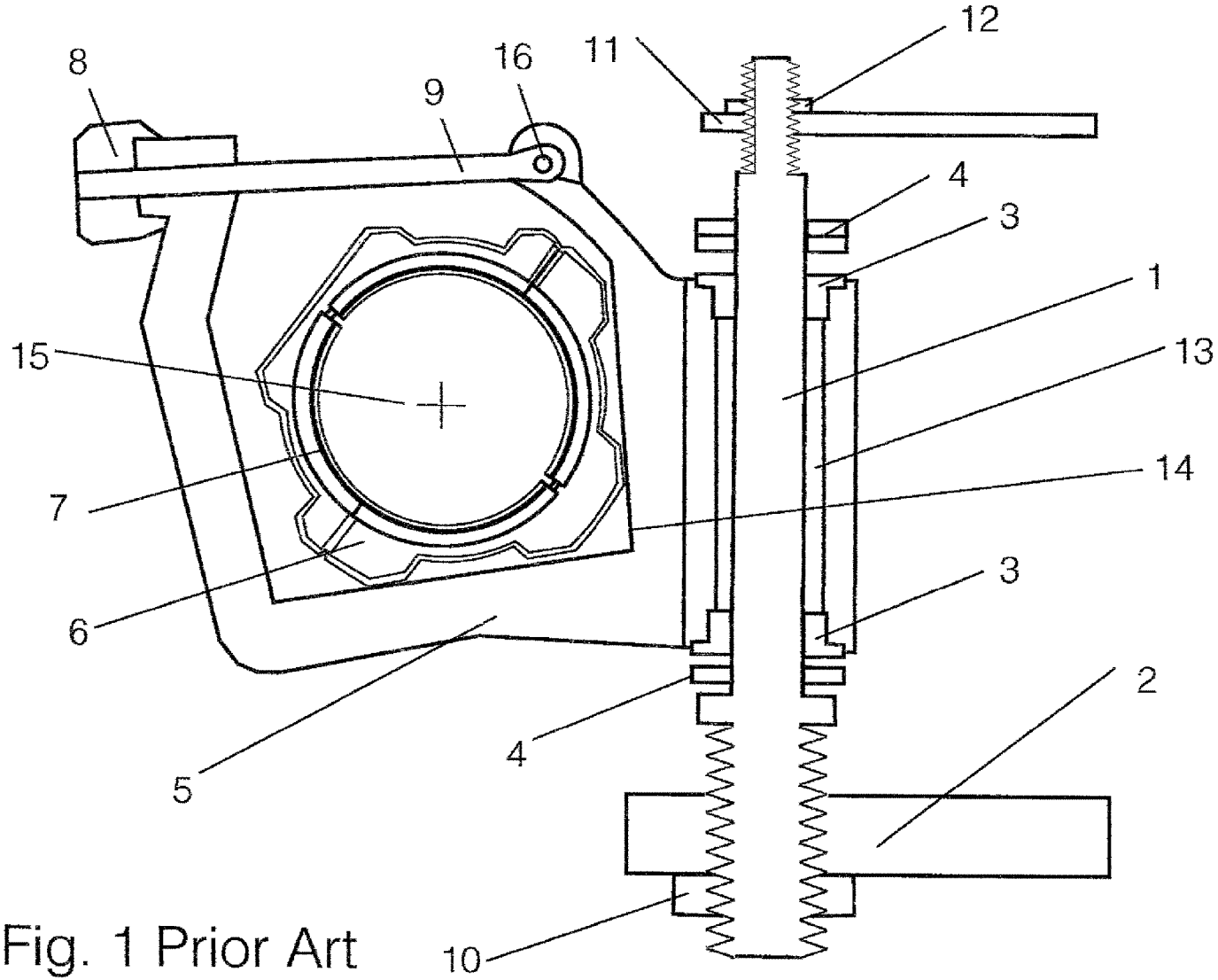
Fig. 1 Prior Art
FIG. 1 is a cross-sectional illustration of a typical prior art oarlock assembly

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Rather, these embodiments are provided so that this disclosure will be thorough and complete, and will fully convey the scope of the invention to those skilled in the art. Like numbers refer to like elements throughout. As used herein the term "and/or" includes any and all combinations of one or more of the associated listed items.

The terminology used herein is for the purpose of describing particular embodiments only and is not intended to limit the full scope of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The following terms, as used herein, have the following meanings:

"Boat" or "rowing shell" refers to sweep boats, sculling boats, canoes, and any other rowing boats for which it would be convenient to provide a central axis oarlock or provide constant gearing throughout the arc of an oar in a boat.

"Bushing" refers to a sleeve, lining, or mounting component that accepts a structural "pin" or cylinder portion of an oarlock, into a mounting aperture, e.g. of a rigger. A bushing may allow the pin or cylinder to rotate (axially) within the bushing while providing vertical and lateral/horizontal support to the pin or cylinder. A bushing may be used to insulate or prevent a direct structural connection between a rigger (or portion thereof) and an oarlock. A bushing may also include a height adjustment element. In a non-limiting example, a bushing may have threading to provide a threaded spacer bolt to adjust the height/distance of the oarlock relative to the rigger mount. A bushing may also have secondary connectors for connecting, e.g. a support arm, or other structure feature such that a rigger is attached to a lower portion of a bushing, a middle portion of the bushing attaches to a secondary structure, e.g. structural arm, and an upper portion of the bushing is used for mounting the oarlock.

"Gearing" is defined as the relationship of the overall length of the oar, less the inboard portion of the oar, divided by the Spread of the Oarlock.

$$G=(\text{Oar Length}-\text{Inboard})/\text{Spread}$$

"Keeper pin" refers to any latch or gate mechanism that is the part of the oarlock that, when opened, provides access to the oarlock for inserting an oar, and that, when closed, secures the oar within the oarlock. As used herein, in one non-limiting example, a keeper pin may be a hinged swing-arm connected to fixed portions of the oarlock enclosure. A keeper pin also encompasses a locking mechanism such as a latch, a threaded component, a spring or biased component, or functionally similar locking device to secure the keeper pin to a fixed portion of the oarlock enclosure.

"Pin" refers to the structural component that connects the rigger to the oarlock. A pin, in one non-limiting example, may be a vertical cylindrical member having a lower portion that engages and mounts on or within an end portion of the rigger closest the oarlock. The lower portion may be secured by means of threaded connections, or may include other means of securing to the rigger such as a cotter pin or secondary pin that fits within a drilled-through-hole in the lower portion of the Pin. The Pin in one embodiment may be height-adjustable. Washers, spacers, threaded adjustable nuts, or a series of vertical apertures in the Pin, and so forth, are used to adjust height.

"Rigger" means the structural frame attached to the gunwale (gunnel, or side) of a boat that is used for mounting the oarlock. Riggers include a lower, main strut, and may also include a secondary upper or top strut.

"Spacer" refers to plastic/polymeric inserts that are placed on or within the inner surface of the oarlock, and/or are placed on or around the pin to adjust the height of the oarlock. An oarlock spacer is used to adjust the pitch of the oar within the oarlock. An oarlock spacer may be used to reduce the inner circumference of the oarlock, and to mount the oar in an offset position to change the pitch of the oar mounted within the oarlock. An oarlock spacer may also be used to minimize wear of the inner surface of the oarlock from the movement and action of the oar and oar collar mounted within the oarlock. One or more oarlock spacers can be placed within a single oarlock.

In a non-limiting example, one spacer may be used to adjust pitch, and a second spacer may be used to reduce wear and improve fit of the collar within the oarlock. One spacer may fit about the inner surface of the fixed portion of the oarlock, while a second spacer is positioned along the keeper pin/opening side of the oarlock. A spacer may comprise a partial, circumferential, unitary component that is positioned along multiple sides of the inner surface of the oarlock. A spacer may be attached to the inner surface of the oarlock by screws, clamps, pins, buttons, or other connectors that provide a secure attachment during operation, as well as an ability to quickly remove and/or replace spacers with another spacer of a different pitch configuration, thickness, durability, lubricity (from the polymer surfaces) to accommodate different conditions, boats, rowers, and so forth.

A pin-located height spacer is used to adjust the height of the oarlock relative to the rigger, gunwale, or rower seat. A pin-located height spacer may also be used to adjust the pitch of the oar due to the change in angle from its modified height. A pin spacer also minimizes wear of the oarlock on the bushings or rigger connections. Multiple spacers may be used on a single pin.

In a non-limiting example, a pin-located height spacer is a plastic washer or series of washers that slide onto the cylinder of the pin (if a non-split washer) or that are snapped on around the circumference of the cylinder of the pin (if a split washer).

"Spread" is defined as the center of the oarlock pin to the center of the shell or boat. The higher the gearing the harder it is to pull the boat past the oarlock pin. Conversely the lower the gearing the lighter it is to pull the boat past the oarlock pin. Gearing is not constant through the arc of the stroke.

"Support arm" or "C-shaped arm" refers to a structural element that provides support to an oarlock mounted (indirectly or directly) to a rigger. In a non-limiting example, a support arm may be shaped in a bowed, partially cupped e.g. vertical cup hilt, or rounded C-shape. A support arm extends vertically from the area adjacent the lower portion of the pin, e.g. below the oarlock, to an area adjacent the upper portion of the pin, e.g. above the oarlock. The support arm may be used to add structural support to the pin when the pin is exposed to various lateral forces during operation of the oar. The support arm may be bowed, or may be rectilinear. The support arm may be positioned to extend around the oarlock on the side nearest the boat/gunwale. The support arm is designed to (located) not interfere with opening of the keeper pin, insertion or replacement of the pitch inserts, or mounting/dismounting of the oar from the oarlock.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

DETAILED DESCRIPTION OF THE FIGURES

Referring to the drawings, FIG. 1 shows a front and side view of a typical oarlock, oarlock pin, rigger and pitch bushings assembly (the "Assembly"). Oarlock 5 which is rotatable secured to an oarlock pin 1 and is fixedly secured to the gunwale of a boat of a rowing shell by suitable struts, including a top struct 11 secured by nut 12 and main strut 2 secured by nut 10. An oar 15 with an outer edge 7 is received into the oarlock surround by collar 6. The oar 15 moves rotational in the oarlock 5. The relationship of angle of surface 14 to oarlock pin 1 is defined as the pitch of the oarlock. The pitch is adjusted by pitch bushing 3 that has an opening to receive the oarlock pin 1 that vary in symmetry and allow for the entire oarlock to be attitude adjusted. The height of oarlock 5 in relationship to the rigger 2 is adjusted by height washers/spacers 4. Height washers below the oarlock 5 are moved above the oarlock 5 to reduce the distance between the oarlock 5 and the rigger 2. Pressure is exerted against surface 14 and transmitted to the oarlock pin at point 3. The pressure is then transmitted to the Oarlock Pin 1 and to the boat through the Rigger 2. Oarlock Pin 1 is typically made of stainless steel or other strong metals is designed to resist deflection/deformation and is further reinforced with a 'backstay" at its top connected to the gunwales of the boat to remain in a constant vertical position. The oarlock Assembly FIG. 1 is a typical representation of all the assemblies used at the Olympics, World Championships, College, and High School Regattas.

Figure 2:
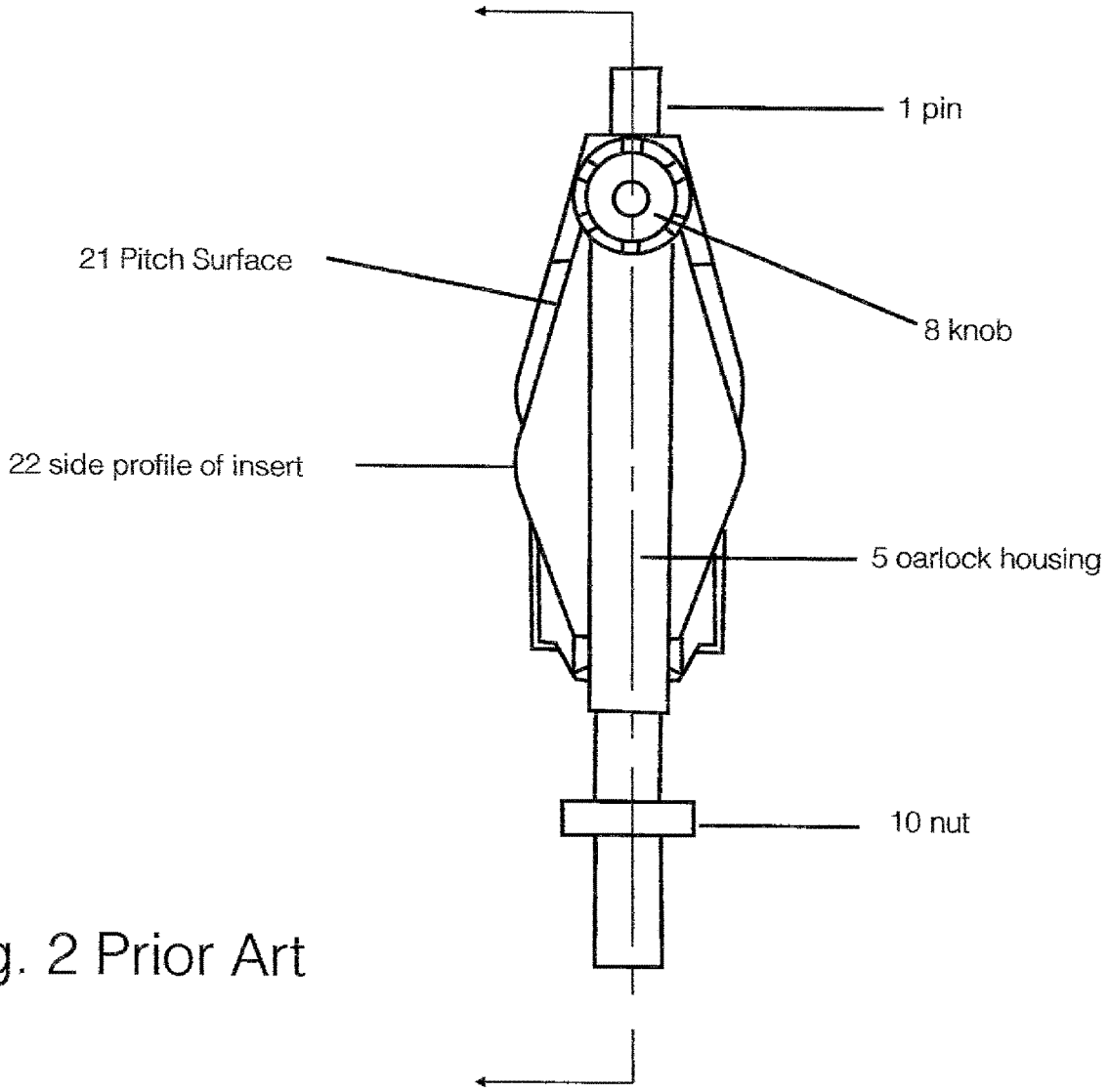
Fig. 2 Prior Art
FIG. 2 is a side view of a typical prior art oarlock.

FIG. 2 is a side view of an oarlock and shows pin 1 holding oarlock housing 5 to a rigger via nut 10. Plastic pitch insert 22 is shown as having a specific pitch surface 21 for guiding a rower during the rowing motion.

The transmission of the rower's power is dependent on the relationship of the oar to the rower's body and the surface of the water. This relationship or geometry is determined by, the inboard and outboard lengths of the oar, stern and lateral pitch, the catch angle of the oar, and the height of the oarlock relative to the water.

The riggers of modern rowing and sculling boats are adjusted according to the needs of the individual rower or sculler, or more generally to give the best comprise for the efficient propulsion of the boat. Each rigger is adjusted with reference to measurement of three principle parameters, namely, height, spread or span, and pitch. The spread of the rigger of a rowing boat is the distance from the center of the boat to the center of the oarlock, whereas for sculling boat the corresponding parameter is normally expressed in terms of span which is the distance between the center of the oarlocks of the opposed pair of riggers, or in other words, the sum of the spread of each.

In the racing shell, the oarlock, supports the oar, pivots on an oarlock pin which is supported by a rigger attached to the gunwale of the shell. The rigger and oarlock are designed to allow the oar to move during each stroke: (a) to rotate about the longitudinal axis of the oarlock pin (allowing the oar to sweep through an arc which lies in an essentially horizontal plane); (b) to rotate about an axis which is perpendicular to the longitudinal axis of the oarlock pin (allowing the oar to sweep through an arc which lies in an essentially vertical plane), and (c) to rotate about the oar's own longitudinal axis (allowing the blade of the oar to be "feathered" or "squared" as necessary throughout the stroke).

Figure 3:
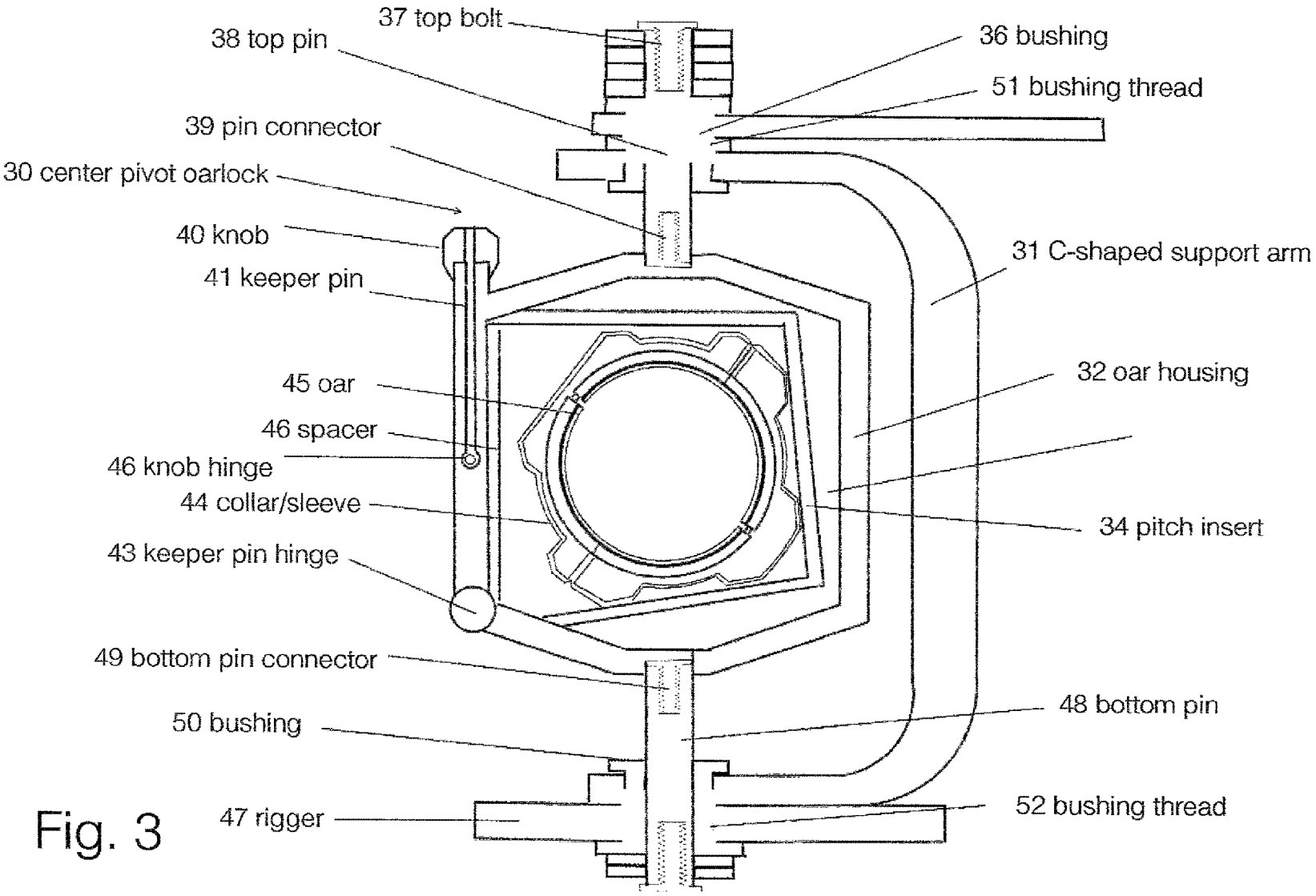
FIG. 3 is a cross-sectional illustration showing a preferred embodiment of the center pivot oarlock of the present invention suitable for a stern mounted wing rigger with a backstay.

Referring now to FIG. 3, the partial cross section of the side view one preferred embodiment of the center pivot oarlock 30 to an existing rigger 47 with a backstay 35. Unlike the FIG. 1 prior art, the oarlock 30 and the oarlock pins 38, 48 are not attached to the rigger 47 directly. At the terminal ends of the oarlock assembly two bushings 36 and 50 are inserted into the opening of a supporting arm 31. Supporting arm 31, is constructed with materials of sufficient strength to resist the bending moment the oarlock 30 exerts. In the prior art FIG. 1, the pin is firmly attached to the rigger, and as force is applied to the pin, the torque is sufficient that it may bend the pin. As such, it is common in to use a backstay to resist the torque and to maintain a vertical attitude of pin. The backstay is securely attached to the top of pin and then is attached to the gunwale of the shell.

In one preferred embodiment, the outer surface of bushing 36 and 50 is round except for a tab that mates to a tab opening in terminal ends of supporting arm 31. The bushings 36, 50 are firmly attached to the rigger 47 or backstay 35 by a treaded counter part 51, 52. In a similar fashion the upper bushing 36 is inserted into the opening in the upper portion of the supporting arm 31 and then through the backstay 35 of the overall support assembly. The supporting arm 31, firmly affixed between the top pin 38 and backstay 35, or the bottom pin 48 and rigger 47, transmits the force exerted to the bushings 36 and 50 by the oar pressing against the oarlock housing 32.

The oarlock housing 32 may be a one piece assembly, or may be made of multiple pieces to form one uniform body. FIG. 3 diagrammatically shows a three-piece assembly consisting of a support arm 31, upper and lower pin and bushing connector assembly 48-49-50, 36-38-39, and center pivot oarlock housing 32 with hinge 43, optional pitch insert 34, and keeper pin assembly 40-41-42. When consisting of three pieces the individual components may be secured with the use of suitable bolts or other mechanical attachments.

The oarlock pin 38, 48 may be moved vertically and rotationally in the bushings 36, 50. The height of the oarlock housing 32 is adjusted by the vertical movement between the bushings 36, 50. The height of the oarlock housing 32 is limited by C spacers located on the above and below the bushings 36, 50 as desired.

In the prior art the oar is surrounded by a plastic collar that is inserted into the oarlock body by the opening of "keeper" pin that pivots upward from a hinge. Similarly, keeper pin 41 is locked into place of the body of oarlock 32 by a knurled knob 40 that is tightened around the keeper pin 41. The keeper 41 provides rigidity to the oarlock 32. In the preferred embodiment FIG. 3 the oar 45 and the collar 44 are inserted into the body of the oarlock housing 32 with optional pitch insert 34 when the keeper pin 41 is in an open position, i.e. when the oarlock pin 42 has enabled keeper pin 41 to rotate about hinge 43. The keeper pin 41 is securely attached to the body of the oarlock housing 32 at point 17.

Figure 4:
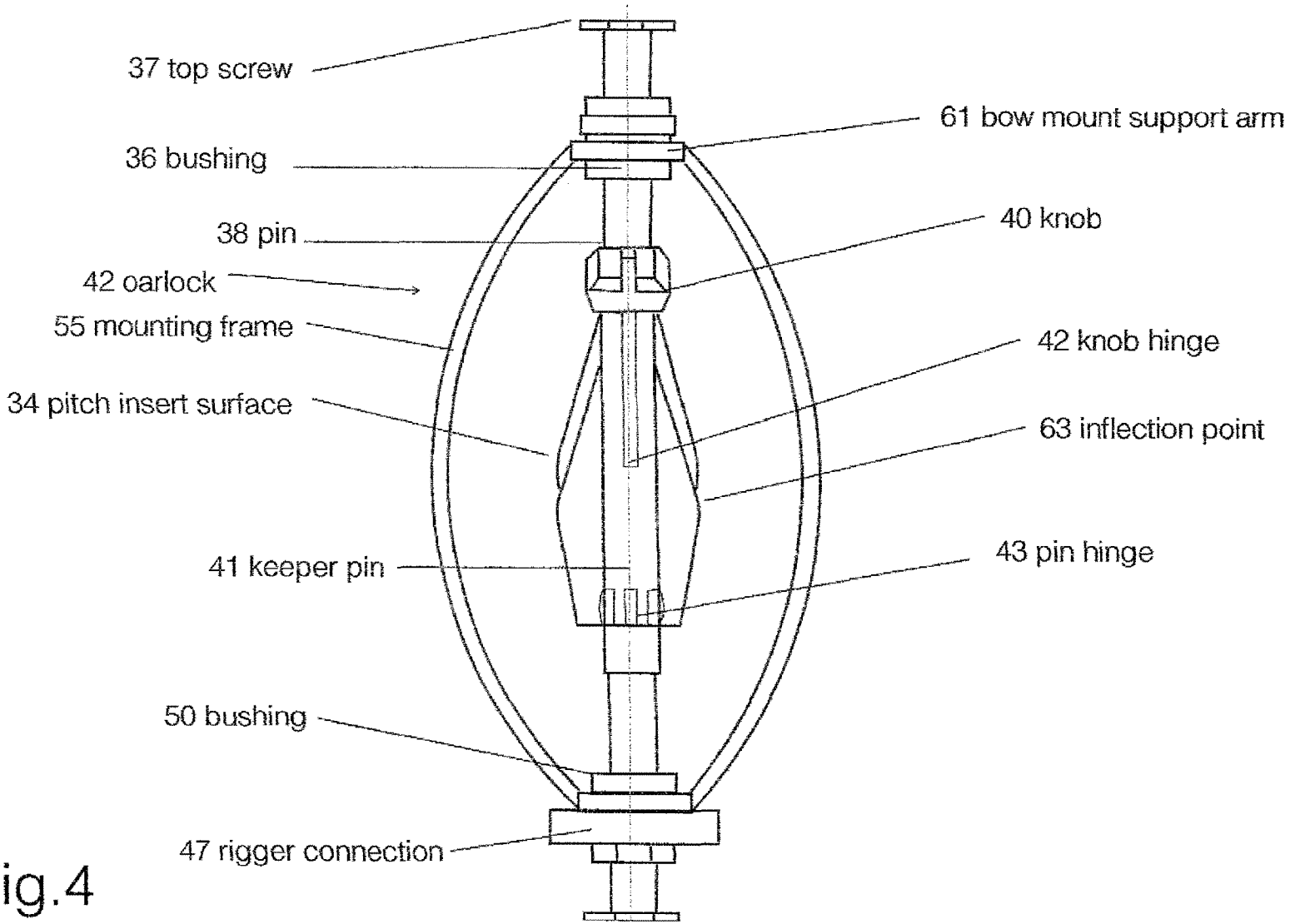
FIG. 4 is a side view illustration showing a preferred embodiment of the center pivot oarlock of the present invention.

Referring now to FIG. 4, a side view shows oarlock 42 mounted between upper rigger connection 35 and lower rigger connection 47. FIG. 4, shows how a rigger frame need not have an upper and a lower frame component, but rather a single lower mounting connection, similar to prior art offset oarlocks, can be used when bow-mount mounting frame 55 is used. Top bushing 36 and bottom bushing 50 connect bow-mount support arm 61 to pin 38. Knob 40 and knob hinge 42 are shown connecting the keeper pin 41 to oarlock 42 via pin hinge 43.

Figure 6:
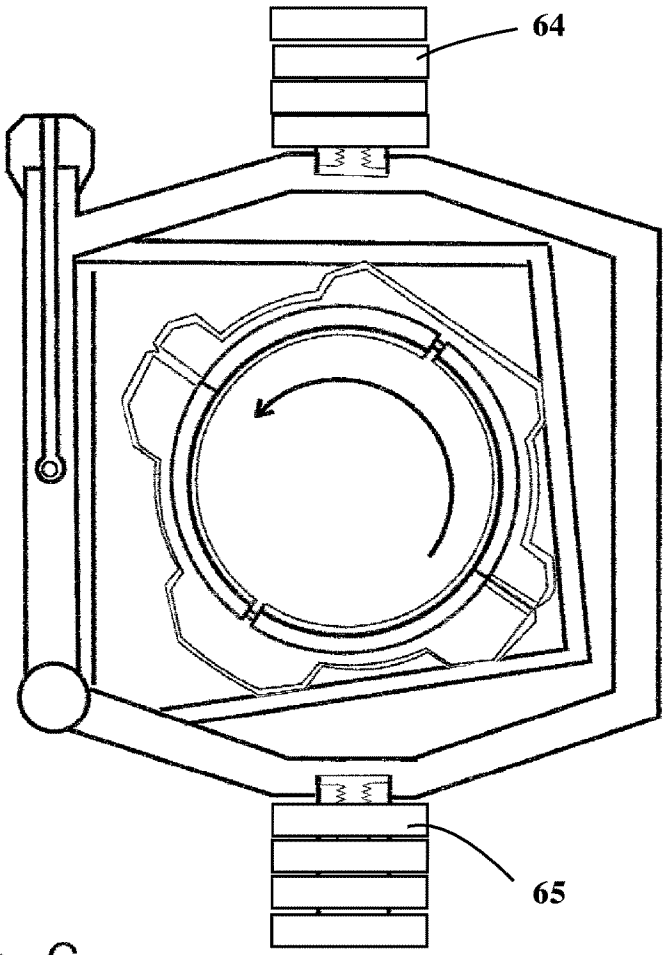
FIG. 6 also shows a cross section illustrate showing the movement of an oar and its collar in a preferred embodiment of the present invention.
Figure 5:
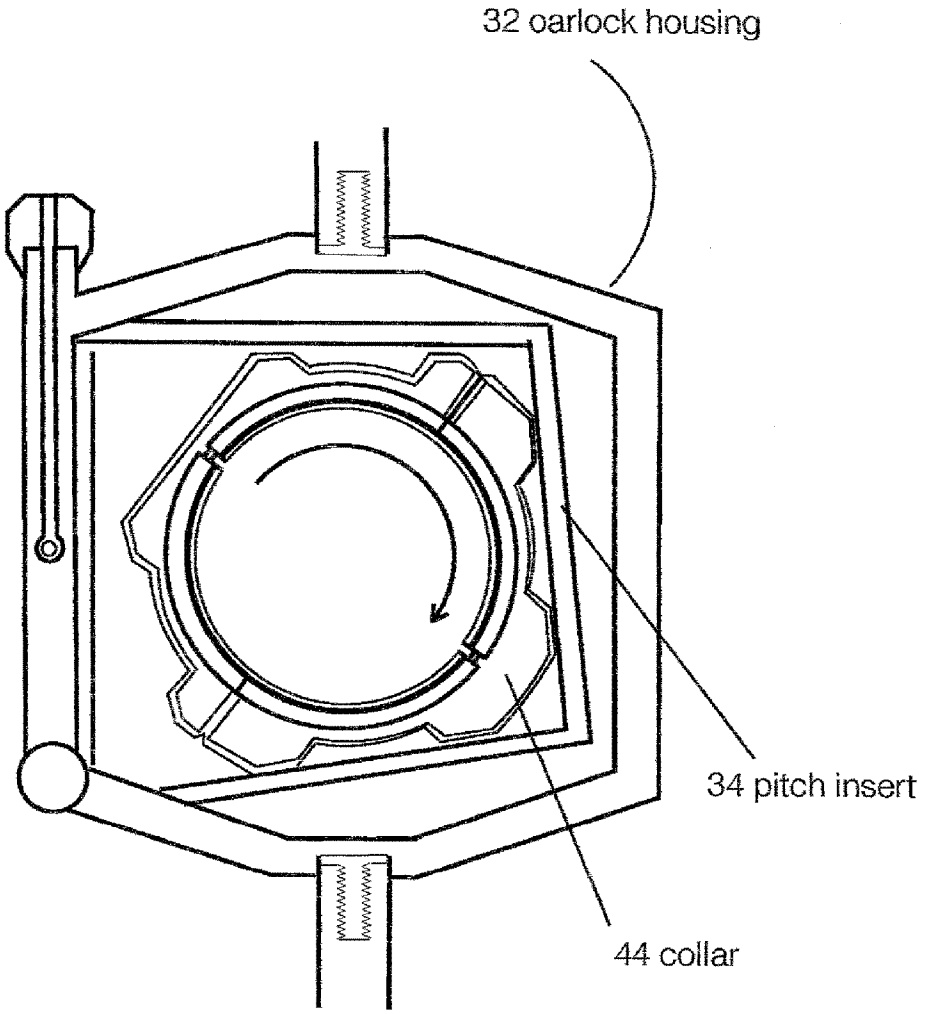
FIG. 5 shows a cross section illustrate showing the movement of an oar and its collar in a preferred embodiment of the present invention.

FIG. 5 shows the cut away side view of the present invention and a commercial available oar and collar. In FIG. 5, the collar is in catch or drive phase and the oar must then be rotated clockwise to get to the recovery phase. In FIG. 6 the collar is in the recovery phase and must be rotated clockwise to go to the drive phase.

Referring to FIG. 6, there is also shown spacers 64, and 65 for adjusting the height of the oarlock relative to its position mounted on the pin/rigger assembly. Raising and lowering the height of the oarlock changes the pitch of the oar. Importantly, the pitch also plays a large factor in output of force for a rower. Ignoring pitch can lead to inefficient strokes and slower times. Previously, the time required to disassemble and re-assemble oarlocks in order to insert the correct height spacers and have the pitch adjusted correctly is well over an hour. In many cases, coaches do not know or do not bother with adjusting the spacers and pitch of the oar at all because of the difficulty. At highly competitive levels, this pitch is imperative. Rowers know the difference between a 4/4 setup and a 3/5 setup—number of upper spacers versus lower spacers. However, the spacer adjustment must take into account each boat, each rower, and each oarlock, making the set-up of a boat before a competition a labor and time intensive proposition.

Figure 7:
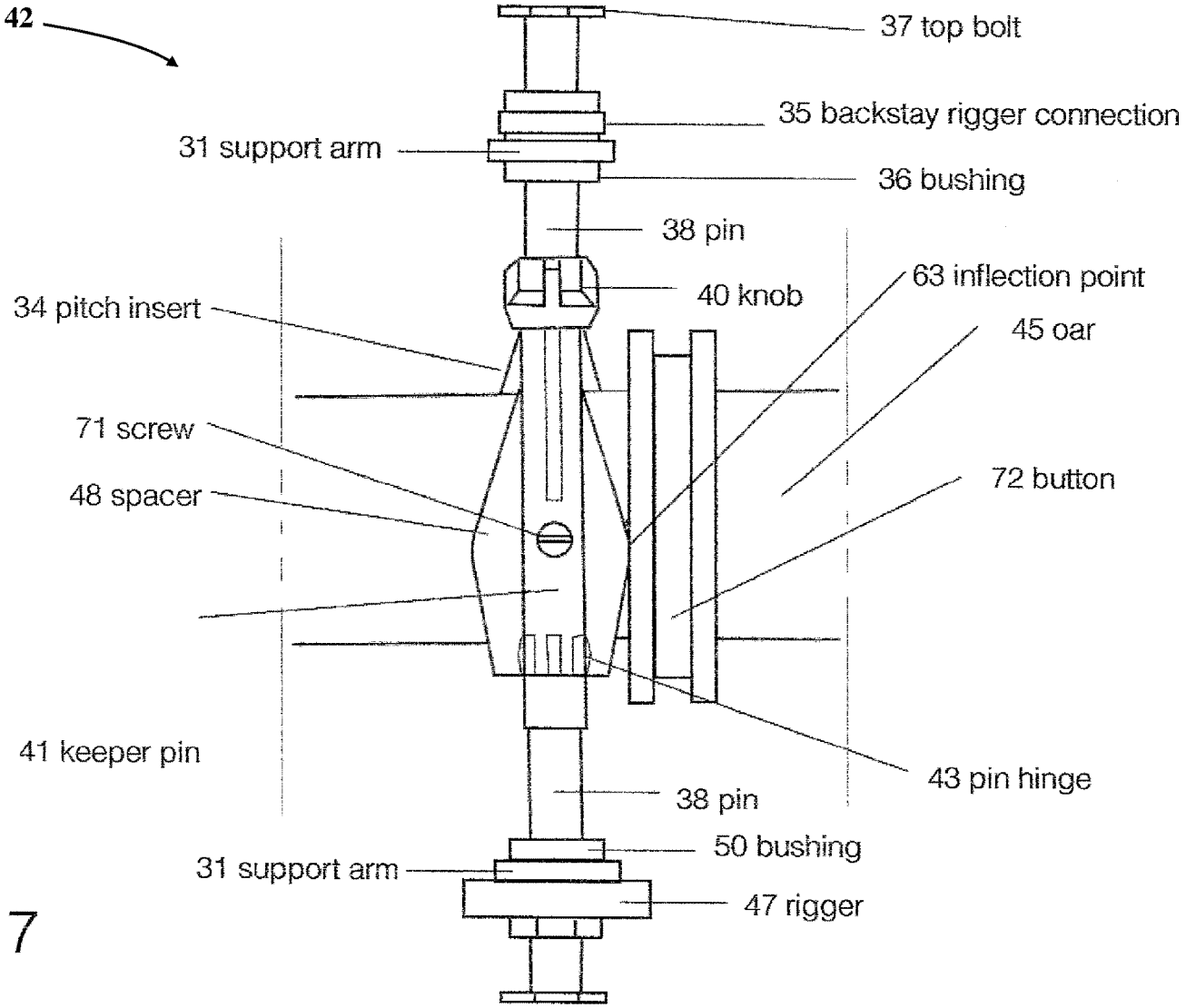
FIG. 7 shows a side view illustration showing a preferred embodiment of the center pivot oarlock of the present invention with the oar in the 'feature' position.

Referring now to FIG. 7, a side view shows oarlock 42 mounted between upper rigger connection 35 and lower rigger connection 47. Top bushing 36 and bottom bushing 50 connect support arm 31 to pin 38. Knob 40 and knob hinge 42 are shown connecting the keeper pin 41 to oarlock 42 via pin hinge 43.

A pitch insert/stern wear plate 34 is optionally attached with the use of a through hole and screw and nut assembly 71. Unlike the FIG. 1 prior art oarlock where the wear surface is molded into the oarlock, in the present invention the pitch insert/wear surface 34 is simply removable and replaceable, without the requirement to disassemble the the entire oarlock assembly. Similarly, the time required to disassemble and re-assemble oarlocks in order to have a correct pitch insert and have the pitch adjusted correctly can also be well over an hour. As with spacers, some coaches do not know or do not bother with adjusting the pitch inserts of the oarlock because of the difficulty with opening the keeper pin, removing the oar, placing the correct insert, and reassembling the oar into the oarlock. As noted, at highly competitive levels, this pitch is imperative. However, as with height spacers, the pitch adjustment must take into account each boat, each rower, and each oarlock, making the set-up of a boat before a competition a labor and time intensive proposition. FIG. 7 shows a side perspective of the invention and a typical oar 45 and button 72. The oar 45 and button 72 are typical as to commercial available products. The present invention is properly dimensioned to accommodate all commercial available oars, collars and buttons. As shown in FIG. 7 the oar 45 is in the recovery phase of the stroke. From the finish position FIG. 6 the oar is rotated counter clockwise to move to the catch position. As the oar is rotated to the catch position, the oar pivoting on FIG. 7 inflection point 63 to FIG. 8 pitch surface 34. With the button 72 held firmly by outward pressure on the oar 45, the depth of the oar in the water is limited by the angle of FIG. 8 surface 34.

Figure 8:
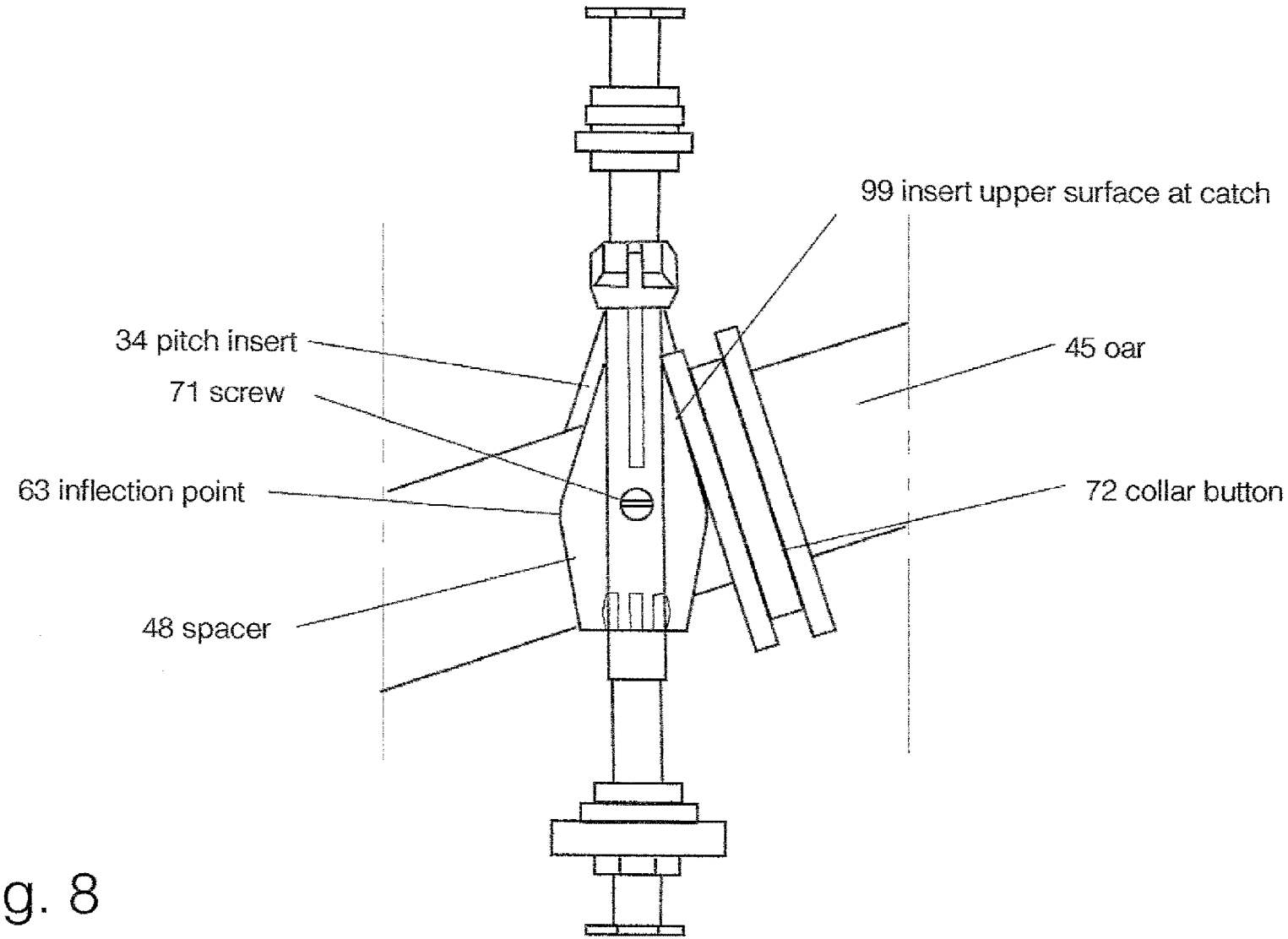
FIG. 8 shows a side view illustration showing a preferred embodiment of the center pivot oarlock of the present invention with the oar in the 'drive' position.

Referring now to FIG. 8, oar 45 is shown at a catch angle with button 72 fully engaged against the upper surface 99 of the pitch insert 34. Pin 38 remains vertical as the oar 45 rotates about the inflection point 63.

The pitch of the oar is determined by the relationship of the pitch insert 34 surface and the vertical angle of the pin 38. Oars must travel through the water with a slight forward angle of between 3-5 degrees from vertical, similar to the spreading motion of a butter knife. If Oars were to travel at a 90 degrees, the pressure against the face of the oar would cause the oar to 'bounce' in the water as the pressure would flow vertically and horizontally against the face of the oar blade. As a wing through the water the pressure against the face of the blade escapes out of the bottom of the blade and the rower is able to pull the oar at a constant depth. If the blades were pulled at an angle less then ninety degrees, the oar will dive and slice into the water. At speed such slicing can exert enough force to eject the rower out of the boat. In the prior art FIG. 1 the pitch of the oarlock is determined by the movement of surface by the insertion of varying offsetting pitch spacers. For example, an asymmetrical spacer setup can be used that tilts the entire oarlock over by 1 to 4 degrees. However, on the prior art, in order to change the pitch of the oarlock, the Rigger Assembly must be completely disassembled, and new pitch spacers inserted and re-assembled.

One of the primary advantages of this invention is that the pitch of the oarlock can be adjusted without the disassembly of the oarlock assembly. Both pin washer types spacers and oarlock insert spacers can be inserted easily since invention uses a center-position bushing feature. Pitch in FIG. 3 is also controlled by pitch insert 34. Pitch insert 34 is designed to accept a wedge of plastic or similar material that can augment the native pitch of oarlock 32. Once attached, the pitch wedge 34 provides a firmly attached surface at the desired pitch. It may be easily removed as is necessary.

In an alternative preferred embodiment of the center pivot oarlock 30, there is a single-connection point to a rigger, a bow mounted support arm 61, instead of a two-point connection to a rigger support frame such as rigger 47 and backstay 35. Unlike FIG. 3, in this preferred embodiment the supporting arm 61, is attached at point 18, to a rigger that is attached to the boat. In this embodiment, there is no backstay (FIG. 3 item 5) required. The oarlock housing 32 is fully suspended between the two bushings 36, 50. The torque exerted by the oar during the drive phase FIG. 8 is fully resisted by the (single) support arm 61.

Figure 9:
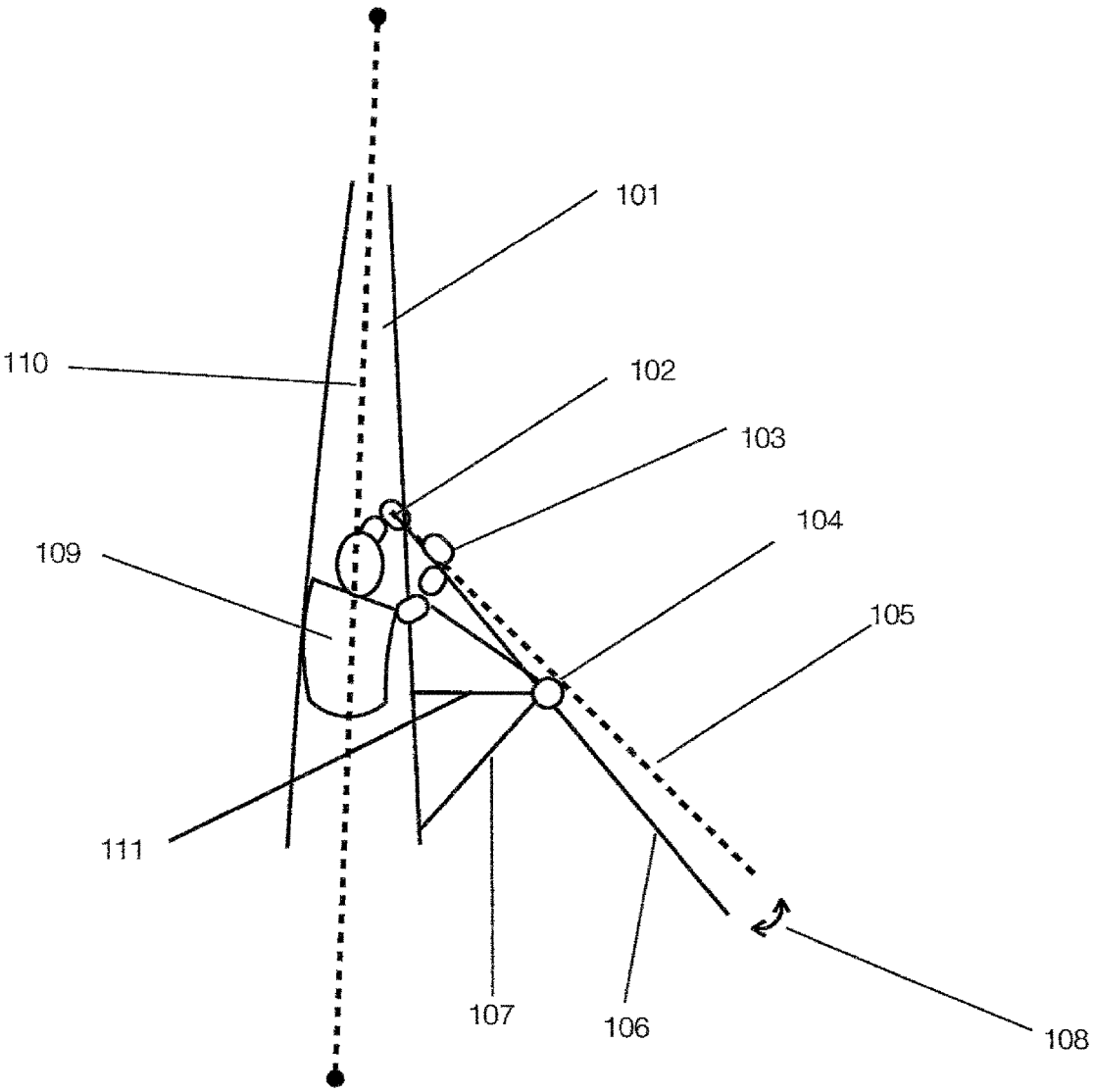
FIG. 9 shows an 'aerial' view of a rower with the catch angle of the prior art and the preferred embodiment illustrated.

In FIG. 9 there is shown the typical position of a sweep rower 109. The rower is facing to the stern of the boat 101. The 'outside' hand 102 is shown at the position of the catch. The 'inside' hand 103 is shown outside the gunwale or side of boat 101. The center of the preferred embodiment oarlock 104 is shown with the center line of an oar 106 intersecting it. The comparative center line of a prior art oar 105 is shown in the location of a prior art oarlock. The rigger 107 is shown comprised of two members. However, the invention contemplates the use on riggers having a single structural arm, or multiple structural arms connecting the rigger to the boat.

As shown in FIG. 9 the catch angle 108 of the oar is limited by the geometry and relationship of the outside hand 102 to the center of the oarlock 104. The rower's body 109 is shown in a twisted position and leaning into the rigger 107. The inside hand 103 does not limit the arc of the oar and is shown with a slight bend in it. The preferred embodiment maintains the relationship of the center of the pin of the oarlock 104 with the center keel 110 of the boat.

A longer stroke through the water yields a faster boat, thus an increase in the "catch angle" 108 of the oar 106 to the centerline of the boat 110 results in a longer stroke and therefore a faster boat. In FIG. 9 the preferred embodiment increases the catch angle 108 from 5 to 10 degrees from that achieved with the prior art, without any increase in the position of the Hand 102 to the center of the boat 110. The movement of the boat does not maintain a constant speed through the water nor does it accelerate at a constant rate. Instead the boat moves the slowest at the catch of the stroke and continues to brake until the oar is pulled approximately to the 45 degree angle. This point on the acceleration curve is known as the Zero G line, where the boat is neither accelerating or braking. The longer the stroke, the earlier the Zero G Line of acceleration is achieved and the boat spends more time in the positive acceleration phase. The present invention achieves a more positive acceleration earlier in the stroke, and therefore increases boat speed.

Prior art oarlocks cannot be moved closer to the FIG. 9 rower 109 to achieve the same geometry. In the prior art, the body of the oarlock is supported by one arm of the oarlock and by a pin. The body of the oarlock transcribes an arc away from the center of the pin. While the arc of the movement oarlock is circular, its relationship to the pin, to the body of the rower, it is not, as the body of the rower is fixed to the center line of the boat. The asymmetrical movement of the oarlock is not consistent with the movement of the hands of the rower. Moving a prior art oarlock such that the center of the oarlock was consistent with the location of the center of the present invention would reduce the length of the oar between the pin and the outside hand and therefore significantly decrease the leverage of the outside hand on the fulcrum point of oar.

The relationship of the outside hand to the center of the pin and the center of the boat is known as gearing. The relationship is (length of the oar less the inboard)/spread. Spread is defined as the center of the pin to the center of the boat. A typical modern oar is 370 cm in length and a typical inboard is 85 cm and a typical inboard is 115 cm. This geometry produces a gearing effect of 3.00. If the inboard is reduced by 3 cm, the gearing effect becomes 3.03 that produces a significantly greater load on the rower. In calculating the gearing of an oar and prior art oarlock, the calculation of gearing is only correct at one point in the arc. Typical prior art gearing is measured with the surface of oarlock parallel to the center of the boat. As the prior oarlock is moved through the arc around its pin, it moves away from the center of the boat with an ever increasing distance. It is inherent in the prior art oarlock that the gearing is highly variable with the gearing higher at the catch and significantly less at the finish. The impact of the variable gearing is that the oar is harder to pull at the catch and easier at the finish. As the prior art oarlock move toward the finish the gearing moves from 3.03 to 3.00 at mid stoke to 2.97 at the finish.

The following table demonstrates the variable nature of the prior art.

| | At Catch | Mid-Drive | Finish |
|---|---|---|---|
| Outboard | 267 | 267 | 267 |
| Span | 88.88 | 86 | 89.54 |

-continued

| | At Catch | Mid-Drive | Finish |
|---|---|---|---|
| Ratio | 3.3 | 3.1 | 2.98 |
| Feel | Heavy | Normal | Light |

Heavy gearing transfers a lot of power for each stroke but places a big load on the rower; the heavier the load, the greater the demand, and the quicker the rower becomes tired. The outcome is then usually more and more imperfection creeping into technique to maintain power as the rower tires.

With light gearing, the more leverage there is and less power will be transferred per stroke, However, the trade off is the rower will not be under as much load and will not tire as quickly. Technique is maintained, form is held and rowers hold their technique. One of the primary advantage of this invention is that gearing remains constant throughout the entire arc of the drive. With the center of the oar in the center of the oarlock and the oarlock rotating on a center axis and not around the pin, the gearing remains constant through out the stroke.

The change over the arc of the stroke, in the gearing ratio, is not well understood. Fédération Internationale des Sociétés d'Aviron (FISA), the governing body of the sport of rowing, defines FISA Gearing as "nominally the outboard divided by the spread in sweep rowing, where the spread is the distance from the pin to the center keel of the shell. The definition of FISA Gearing ignores the impact of the oarlock not pivoting on its center axis. FISA Gearing is improperly applied to the prior art but is correct for the present inventive Center Pivot Oarlock.

The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

I claim:

1. A center pivot adjustable oarlock, comprising:

an oar housing, the oar housing comprised of a plurality of elongated support members defining an enclosed aperture and configured to receive an oar, and a hinged access gate connected to the plurality of elongated support members for opening and closing the aperture;

a top mounting pin, the top mounting pin comprising an elongated vertically-oriented cylinder connected at a first end to an upper center portion of the oar housing and extending away from the aperture, an upper bushing connected to the top mounting pin, the upper bushing configured to connect to an upper rigger connection; and, a bottom mounting pin, the bottom mounting pin comprising an elongated vertically-oriented cylinder in the same axis as the top mounting pin and connected to a lower center portion of the oar housing and extending away from the aperture in a direction opposite to the top mounting pin, a lower bushing connected to the bottom mounting pin, the lower bushing configured to connect to a lower rigger connection.

2. The center pivot adjustable oarlock of claim 1, further comprising a C-shaped support arm for mounting the oar housing to the upper rigger connection and the lower rigger connection, where the C-shaped support arm is connected at an upper terminus to the upper bushing, and is connected at a lower terminus to the lower bushing, wherein the upper terminus is positioned between the upper rigger connection and the upper center portion of the oar housing, wherein the lower terminus is positioned between the lower rigger connection and the lower center portion of the oar housing, and wherein the C-shaped support arm creates a indirect connection through the upper bushing between the oar housing and the upper rigger connection, and wherein the C-shaped support arm creates a indirect connection through the lower bushing between the oar housing and the lower rigger connection.

3. The center pivot adjustable oarlock of claim 1, wherein the top mounting pin and the bottom mounting pin are threaded, and wherein the oar housing is vertically adjustable along the axis of the top and bottom mounting pins.

4. The center pivot adjustable oarlock of claim 3, wherein the hinged access gate is a hinged elongated arm that is connected to the plurality of elongated support members by a hinge at a lower end of the elongated arm, and is connected to the plurality of elongated support members by a quick-release locking knob at an upper end of the elongated arm.

5. The center pivot adjustable oarlock of claim 3, further comprising a pitch angle insert that is replaceably attached to an inner surface of the oar housing.

6. The center pivot adjustable oarlock of claim 5, wherein the pitch angle insert is wedge-shaped and has a first surface to position the oar at a recovery position during a recovery phase of a stroke, and has a second surface to position the oar at a catch position during a catch phase of the stroke, wherein the pitch angle insert is configured to work cooperatively with a collar button attachment that fits on a sleeve portion of the oar mounted in the oarlock.

7. The center pivot adjustable oarlock of claim 2, wherein the upper bushing has one or more screws for adjustably securing the upper bushing to the upper rigger connection, and wherein the lower bushing has one or more screws for adjustably securing the lower bushing to the lower rigger connection.

8. The center pivot adjustable oarlock of claim 3, wherein the plurality of elongated support members and the hinged access gate connected to the plurality of elongated support members are configured in a geometric shape having 4-12 sides.

9. The center pivot adjustable oarlock of claim 3, wherein the plurality of elongated support members and the hinged access gate connected to the plurality of elongated support members are configured in a hexagonal shape.

10. The center pivot adjustable oarlock of claim 3, wherein the plurality of elongated support members and the hinged access gate connected to the plurality of elongated support members are configured in a toroidal shape.

11. The center pivot adjustable oarlock of claim 3, wherein the plurality of elongated support members and the hinged access gate connected to the plurality of elongated support members are configured in a square shape.

12. The center pivot adjustable oarlock of claim 3, wherein the plurality of elongated support members and the hinged access gate connected to the plurality of elongated support members are configured in a rectangular shape.

13. A method of providing constant gearing throughout the arc of an oar in a boat, comprising the steps of:

providing an oarlock of claim 1 that rotates about a central vertical axis; and horizontally rotating an oar in the oarlock about the central axis of the oarlock.

14. The method of claim 13, wherein the oarlock is the oarlock of claim 3.

* * * * *